US006959145B1

(12) United States Patent
Narvaez

(10) Patent No.: US 6,959,145 B1
(45) Date of Patent: Oct. 25, 2005

(54) FOOTWEAR SNOW MELTING DEVICE USING HEATED AIR

(76) Inventor: Victor F. Narvaez, 69 Nicholas Rd., Apt. L, Framingham, MA (US) 01701

( * ) Notice: Subject to any disclaimer, the term of this patent is extended or adjusted under 35 U.S.C. 154(b) by 0 days.

(21) Appl. No.: 10/939,080

(22) Filed: Sep. 10, 2004

(51) Int. Cl.[7] ..... H05B 3/00; F24H 3/00
(52) U.S. Cl. ..... 392/382; 392/380; 219/213
(58) Field of Search ..... 392/379–385, 392/365–369; 34/90–91, 96–97; 219/213, 219/202

(56) References Cited

U.S. PATENT DOCUMENTS

| | | | | | |
|---|---|---|---|---|---|
| 1,658,489 | A | * | 2/1928 | Lindstrom | 392/382 |
| 2,267,158 | A | * | 12/1941 | Locke | 392/382 |
| 2,599,049 | A | * | 6/1952 | Dollinger | 34/90 |
| 2,779,856 | A | * | 1/1957 | Fahner | 392/382 |
| 2,953,805 | A | * | 9/1960 | Sevenich | 392/382 |
| 3,054,129 | A | * | 6/1962 | Dragoon | 34/90 |
| 3,064,298 | A | * | 11/1962 | Jones | 34/90 |
| 3,411,174 | A | * | 11/1968 | Jordan | 392/382 |
| 4,258,248 | A | * | 3/1981 | Campo | 392/379 |
| 4,782,601 | A | | 11/1988 | Gonzalez | |
| 5,287,636 | A | | 2/1994 | Lafleur et al. | |
| 5,291,000 | A | * | 3/1994 | Hornberger | 219/539 |
| 5,454,060 | A | * | 9/1995 | McDermott | 392/383 |
| 5,613,304 | A | * | 3/1997 | Lin | 34/90 |
| 5,617,646 | A | | 4/1997 | Viscuso | |
| 5,950,269 | A | | 9/1999 | Openshaw et al. | |
| 6,393,717 | B1 | * | 5/2002 | Santos et al. | 34/90 |
| 6,584,636 | B2 | | 7/2003 | Schlem | |
| 6,606,801 | B2 | | 8/2003 | Strang et al. | |

FOREIGN PATENT DOCUMENTS

| | | | | |
|---|---|---|---|---|
| DE | 824689 | * | 7/1949 | |
| DE | 3610560 | * | 10/1987 | |
| EP | 481925 | * | 4/1992 | 392/382 |
| FR | 1454070 | * | 8/1966 | 392/379 |
| FR | 2216529 | * | 10/1974 | |
| JP | 54-10071 | * | 1/1979 | 392/382 |
| JP | 54-150269 | * | 11/1979 | 392/382 |
| JP | 8-154866 | * | 6/1996 | |
| JP | 2004-91457 | * | 3/2004 | |

* cited by examiner

*Primary Examiner*—John A. Jeffery
(74) *Attorney, Agent, or Firm*—Davis & Bujold, P.L.L.C.

(57) ABSTRACT

An apparatus melts snow off a person's footwear without the need for the wearer to take off the footwear. In particular, the apparatus is for melting ice and snow off the footwear, for example shoes, boots or sneakers, of the wearer by a directed and accurately disseminated heat flow. The heat flow is directed in a manner which facilitates the removal, deposition and collection of melting snow and ice from shoes of a wearer at a desired location, e.g., in a threshold or landing, adjacent an entry/exit door of a residence or commercial building before such snow and ice and any contaminant therein can be tracked into the building.

16 Claims, 5 Drawing Sheets

FOOTWEAR SNOW MELTING DEVICE USING HEATED AIR

FIELD OF THE INVENTION

The present invention relates to an apparatus for melting snow off the footwear of a person without the need for the wearer to take off the footwear. In particular, the apparatus is for melting ice and snow off the footwear, for example, shoes, boots or sneakers, of the wearer by a directed and accurately disseminated heat flow. The heat flow is directed in a manner which facilitates the removal, deposition and collection of melting snow and ice from shoes of a wearer at a desired location, e.g., in a threshold or landing adjacent an entry/exit door of a residence or commercial building before such snow and ice and any contaminant therein can be tracked into the building.

BACKGROUND OF THE INVENTION

It is well known that for both residential and commercial buildings in northern climates where winters can generate substantially freezing temperatures with snow and ice, that the tracking in of such snow and ice by persons entering the building can lead to a number of problems. One problem being the issue of safety where snow and ice melting and falling off the footwear of a wearer can cause certain surfaces, for example, tile, stone, concrete and even wood, to become very slippery and dangerous to walk on. This issue is particularly relevant in high traffic areas of commercial structures where accidents and injuries, accompanying such slippery surfaces, raise liability issues for property owners.

Also in cold weather and snowy environments, the wearing of footwear, e.g., boots, shoes and sneakers, for example, track contaminants into the building with the ice and snow. Dirt, road salts, as well as oil from parking lots or any other type of debris which can be suspended in snow and ice, come into the building with the wearer's footwear. This means that upon crossing a threshold without taking off such footwear, the wearer and the boots will track the contaminate laden snow and ice into the building which can be significantly detrimental to floor surfaces, in particular wood surfaces or tile and stone surfaces, for example.

It is well known to use floor mats, rugs or carpets both inside and outside of entrances to assist in melting snow off the soles and sidewalls of a person's footwear. Also in some commercial settings, grates are placed outside or inside adjacent entrances to permit snow, ice and even water falling off a person's footwear to fall through the grate and into a catch basin before the person enters the building.

Certain devices have been used to scrub the bottom sole, and even the side sole of a person's footwear by utilizing brushes and even saturating the brushes with water and detergent to facilitate cleaning the shoes. The draw back to such devices is that only one person can use them at a time, and they often require a particular intent, desire and effort upon the part of the user to take the time and effort to clean off their footwear. Furthermore, such devices can cause accidents as they are generally located in high traffic areas where people can get at them, and are set above the level of the floor where someone might trip or stumble over such a device, of course, this is very dangerous in the vicinity of an entrance.

SUMMARY OF THE INVENTION

Wherefore, it is an object of the present invention to overcome the above mentioned shortcomings and drawbacks associated with the prior art.

Another object of the present invention is to provide a heated air flow which can be directed towards or at the boots of a wearer whether worn or not, in order to melt the snow and ice therefrom.

A further object of the present invention is to provide a grate which permits both the flow through of sufficient air to melt snow and ice from the footwear and also to allow the changed state ice and snow and water dripping from the user's footwear to pass through the grate into a collection basin.

Yet another object of the present invention is to provide such a boot cleaning device which is readily usable and expensive enough to be used in both residential and commercial settings.

A still further object of the present invention is to provide an easy to manufacture and relatively inexpensive device which melts the snow and ice off a wearer's footwear so that the footwear does not have to be removed upon entering a residence or commercial building.

Yet still another object of the present invention is to provide a motor or blower which blows air across a heating element and supplies this heated air through at least a conduit to a plurality of outlets for dispensing through a fence or grate upon which a wearer of the footwear to be cleaned is standing.

The present invention also relates to a footwear melting device comprising a housing having a first and a second section; an opening in at least a portion of a top side of the first section of the housing; a lattice covering the opening; at least a pipe conduit extending from the second section of the housing into the first section of the housing for supplying air flow through the lattice; an air flow source for directing air through at least an opening in the pipe conduit, located in the second section of the housing and connected to the pipe conduit; a heating means for heating air prior to entering the pipe conduit; a drain extending from the first section of the housing to the exterior of the housing for removing water and debris; and a power switch for controlling the air flow source.

The present invention also relates to a footwear melting device comprising a housing containing a blower for developing an air flow; a heating element for heating the air flow and a series of conduits communicating with the blower for relaying the heated air flow to a desired location; a plurality of exhaust openings formed in the series of conduits directing the heated air flow towards a ventilated platform upon which footwear is positioned; and a catch basin aligned below the ventilated platform to capture any material removed from the footwear and direct such material to a drain.

BRIEF DESCRIPTION OF THE DRAWINGS

The invention will now be described, by way of example, with reference to the accompanying drawings in which.

DETAILED DESCRIPTION OF THE INVENTION

Figure 1:
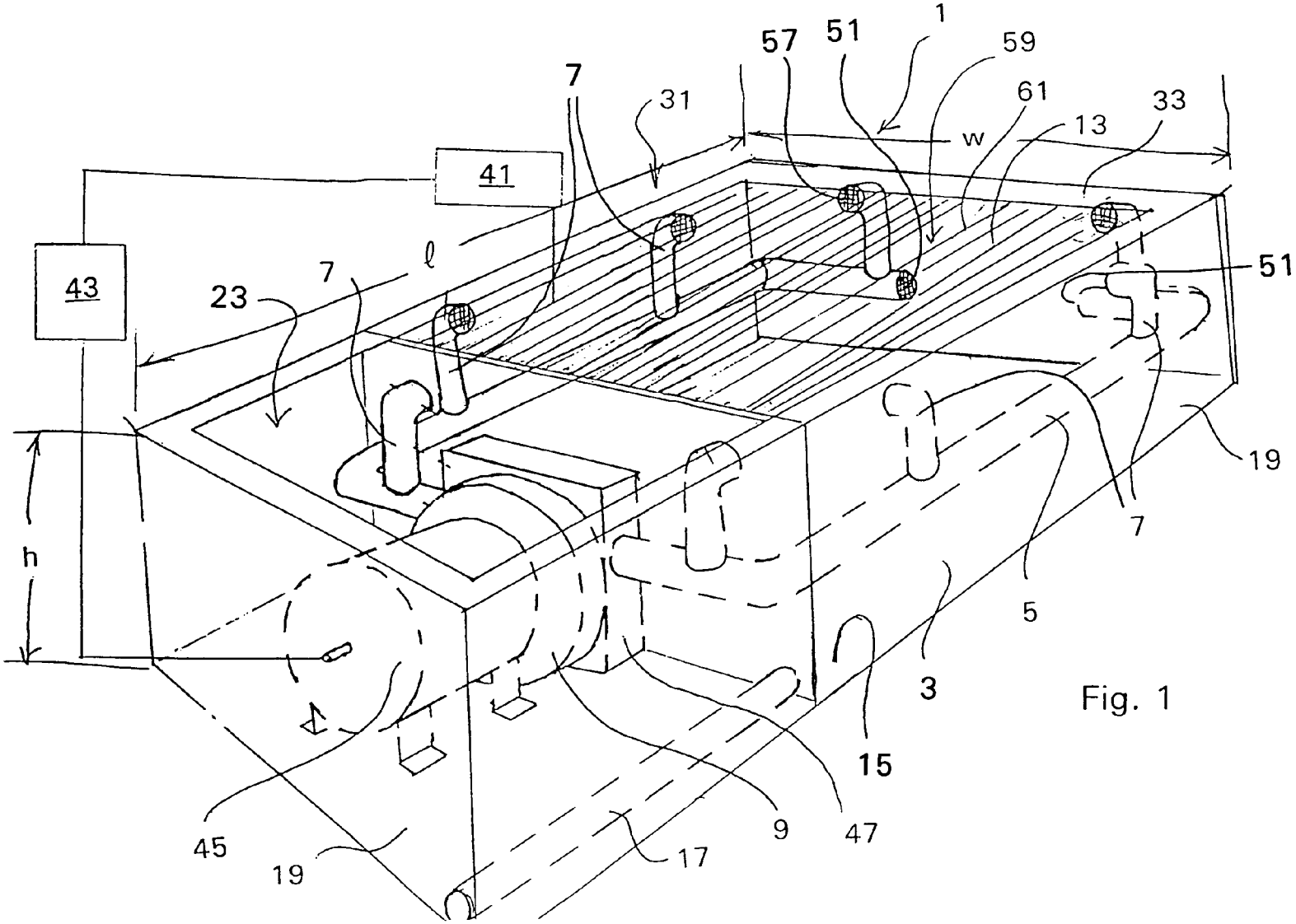
FIG. 1 is a perspective view of the footwear snow-melting device.

Turning now to FIG. 1, a general description concerning the various components of a heating apparatus 1 of the present invention will now be discussed. As can be seen in a first embodiment, a housing 3 or frame supports at least a main conduit 5 for supplying hot air through a number of conduit outlets 7 provided in the main conduit 5. The outlets 7 are generally provided and aligned adjacent an area or surface upon which a person, when wearing boots or other footwear, will tread or pass over before entering a building so that the hot air can be applied as directly as possible to the footwear.

The air is initially supplied to the outlet conduit(s) 7 through a connection with a blower or fan 9 powered by an electric motor 45 via a standard electrical connection, for instance, 120 or 240 volts as is well known in the industry. The blower 9 takes in ambient air through an inlet and accelerates the air via a turbine or fan blade eventually passing the heated air to the conduit 5. The air is passed over or through, a heating element 11 to raise the temperature of the air, much like a hair dryer after being accelerated by the blower. It is conceivable that the air could be heated before or even after being accelerated by the blower 9. The heating element 11 may be of any type known in the art, for example, an electrical resistance wire heater, a heat reservoir from waste heat in a building heating supply or both.

The heating apparatus 1 is provided with a grate or fence 13 as a top surface on the housing 3. The grate 13 covers at least a portion of the housing 3 forming the top horizontal surface upon which the user stands. Besides supporting the user, the grate 13 on the top surface has at least two important functions, the first is to assist in focusing and directing the heated air from the conduit outlets 7 onto the user's or wearer's boots in one direction, generally upwards, and contemporaneously also permit the flow of water and/or melting ice and snow off the footwear downwards into a catch basin 15 from where the water may be drained or evacuated. The bottom of the housing may form the catch basin 15 and have a communicating drain 17 which permits the water to pass out of the housing 3 and, for example, into a standard building drain.

The housing 3 is generally metal and constructed with adjacent sidewalls 19 which may be formed in a square or rectangle, as shown. The sidewalls 19 substantially enclose the blower 9 and heating element 11 and also support the main conduit 5 along an inside surface of the sidewalls 19 via brackets or other known devices. The housing 3, which can be a frame or a solid type enclosure like sheet metal, defines a blower enclosure portion 21 and a conduit enclosing portion 31. The blower enclosure portion 31 houses the blower 9 and heater elements 11 generally and may have a solid top surface 23, as opposed to the grate 13 covering generally the conduit enclosing portion 31. A solid top surface 23 over the blower 9, which can be made removable for access to the blower, ensures that the blower 9 and heater elements 11 are protected from melting water, ice and snow from the footwear.

It is to be appreciated that the housing 3 can be any type of enclosure or weight bearing framework which has sufficient structural stability to support not only the apparatus contained within for generating and disseminating the hot air flow, but also the weight of a person, or person(s) standing on it. Also, the grate 13 may extend over the entire apparatus where a blower 9 and heater 11 are provided which can withstand the application of ice, water and any contaminants such as salt, dirt, etc., from a user's shoes or boots. As such motor and heating components are well known in the art, no further discussion is provided.

The grate 13 can rest upon and be supported by the sidewalls 19 of the housing 3 which may be provided with a lip 33 along a top edge which removably supports the grate 13 so that the grate 13 does not fall into the interior of the frame and damage or interfere with the conduits 7 or blower 9 or cause a safety hazard if dislodged. Although shown in a rectangular box-type shape, it is to be understood that the sidewalls 19 of the housing 3 may be generally formed in any shape, for example, circular to ensure like a manhole cover, that a circular top grate does not fall into the housing 3 and become a safety hazard if dislodged.

In general, the housing 3 can be of any particular size and shape, but for residential purposes can be made, for example, having a sidewall height h of approximately 10 inches and a length l of approximately 28 inches and a width w of approximately 18 inches. Approximately 10 inches of the length l incorporates the blower enclosure portion 21 for supporting and protecting the blower 9 and heating element 11. The blower enclosure portion 21 of the housing 3 is generally provided with a solid enclosure including a solid top surface 23 to protect the blower 9 and heating element 11. The remainder of the length l of the housing 3 being the conduit enclosure 31 and being enclosed by the grate 13 as a top surface.

This size is important in that this apparatus can be readily inserted into a stoop or landing of a house and inconspicuously mounted so that only the top surface of the housing is visible. For commercial building purposes, the enclosure may be of any size or length, for example, to span approximately the same distance as the numerous doors to shopping areas, such as a mall. Also, any number of the housings may be linked or positioned adjacent one another and even operate in concert or independently so that only a particular assembly which is activated is turned on.

A sensor 41, for example, a piezo-electric transducer, may be mounted to the grate 13 which senses an applied weight or load on the grate 13, for example, when a person sets their foot upon the fence or grate 13. The sensor 41 then sends a signal to a motor controller 43 which activates an electric motor 45 to turn on the fan or blower 9 and the heating element 11 and generate the heated air to flow onto or across the person's footwear located on the grate 13. The motor controller 43 can also control the heating of the air by turning on the heating element 11 with the sensing of the applied load so that the heating element 11 or heat is not wasted when the device is not in use. As such sensors for sensing load are well known in the art, no further discussion is provided.

Alternatively, the electrical installation options could include standard switch operated mechanisms or activated photosensor switches with direct electrical connections or via remote control.

Figure 2:
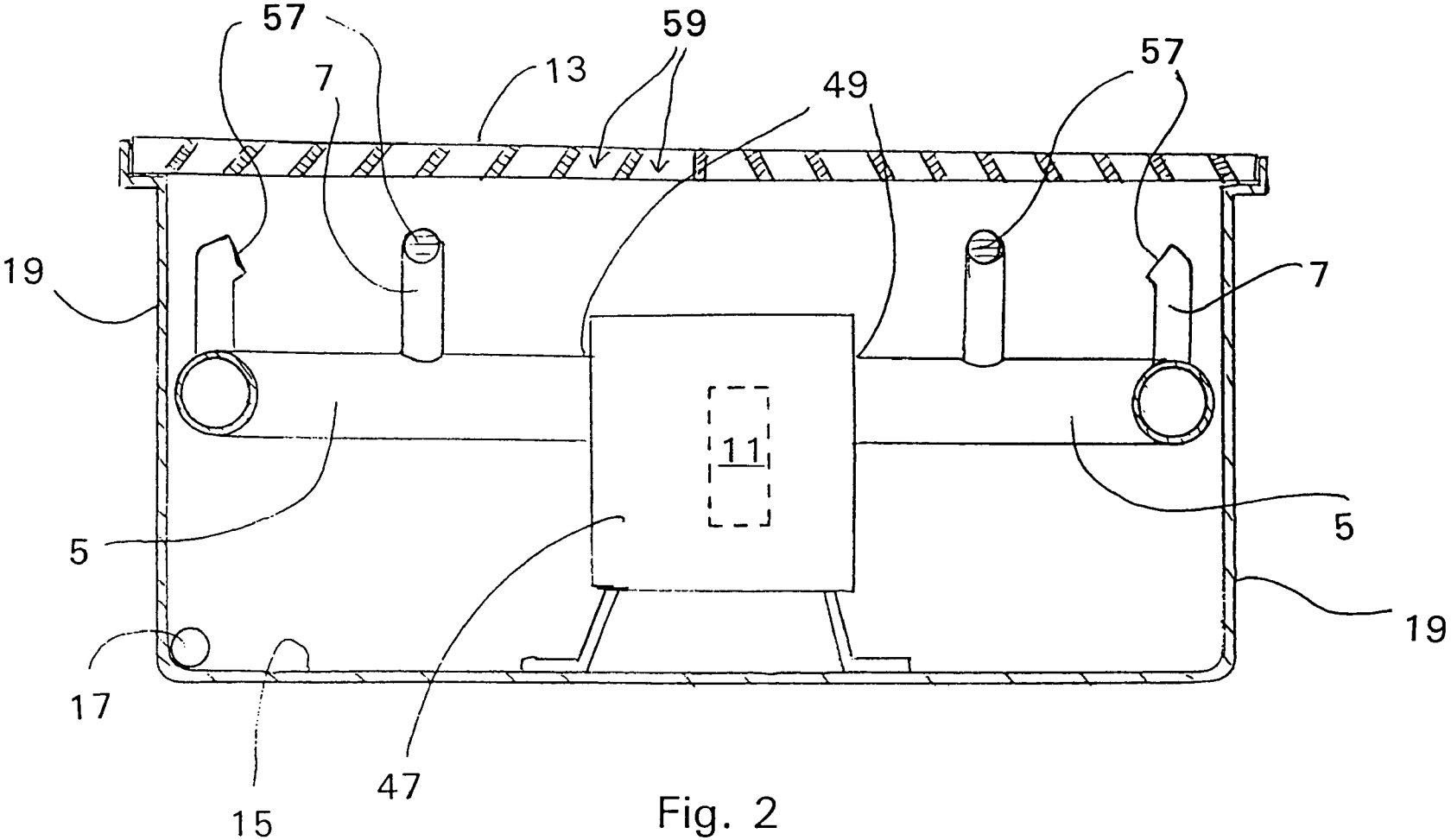
FIG. 2 is a cross-sectional view of the footwear snow-melting device.

The main conduit 5 as shown in FIGS. 1 and 2, has two branches. The two opposing branches extend substantially longitudinally from a hot air atrium 47 which directs the hot air from the blower 9 to the conduits 7. The conduits 7 are connected to the atrium 47 at respective atrium connection points 49 of the conduit 7. The conduits 7 extend a desired distance through the conduit enclosure portion 31 of the housing 3 to free end points 51 of the main conduit 5 which may be provided with an outlet 7 to allow any remnants of hot air out. Alternatively, the free ends may also be solid to provide sufficient air through the intermediate outlets. The main conduits 5 may extend along the sidewalls 19 of the housing 3 and are vertically spaced some distance above the bottom catch basin 15 of the housing 3, generally about halfway up the sidewalls 19 but they may, in fact, be located any distance from the bottom and specifically closer to the grate 13 if a better and more direct air flow therethrough can be attained.

As discussed in further detail below, it is to be appreciated that any number of main conduit branches may be provided, and for that matter any number of outlet conduits 55 can also be provided. For example, a central main conduit (not shown) running down the middle of the conduit enclosure portion 31 of the housing 3 could support a number of conduit outlets 7 extending therefrom or 3, 4 or more main conduits could extend from the atrium 47. The main conduits 5 may be provided with a diameter in the range of 0.25 inch to 2.0 inch, and more preferably about 0.5 inch to 1.5 inches although other sizes could be contemplated as well depending upon the desired air flow rate. It is to be appreciated that the size of the main conduits 5 may vary to accommodate the air flow developed by the blower and fan 9.

Each main conduit 5 is provided with a series of openings communicating with outlet conduits 7 which generally extend upwards at a 90° angle from the main conduit 5. These outlet conduits 7 may be of any desired length to fit within the confines of the housing 3 but are, in general, about 1–6 inches, and preferably about 2–4 inches in length. The outlet conduits 7 may also extend at other angles relative to the main conduit 5 depending on the necessity to dispense the hot air flow in a desired location. The outlet conduits define a free end opening 57 which may be covered by a screen or louvers and which aid in directing the air upwards towards and through the grate 13. The free end openings 57 may direct the hot air, preferably at an angle of approximately 45° relative to the horizontal plane defined by the grate 13 upon which the footwear is placed. This facilitates the forced hot air coming into contact with both the sides and bottom of the footwear in order to provide sufficient melting coverage of snow and ice from the footwear. The opening of the outlets may be angled upwards at a 45° angle or the screen or louvers on the end of the outlet may themselves be angled so as to force the air upwards at the desired angle. It is to be appreciated that in a preferred embodiment of the invention, the angle $\propto$ of the forced hot air upwards is approximately 45°, however the angle could be any where from 25° to 75° or even straight up and down, i.e., 90°, with respect to the horizontal plane of the top surface of the housing 3 as defined by the grate 13.

The outlet conduits 7 are provided spaced along the conduit at about 3 inches to 8 inches apart and more preferably at 4 inches to 5 inches apart. The outlets 7 have a diameter of approximately 0.25 inch to 2.0 inch, similar to that of the conduit, although it may be beneficial to size the outlets 7 and the openings 57 either smaller or larger depending on the desired air flow rate.

Figure 3A:
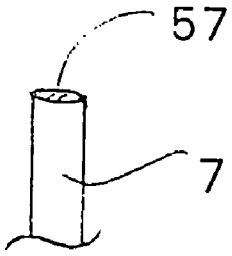
FIGS. 3*a–c* are various embodiments of the outlets.
Figure 3C:
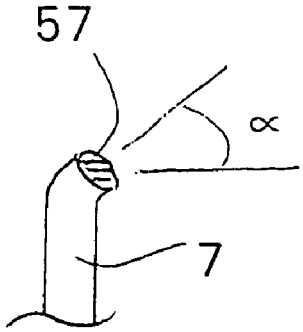
Figure 3B:
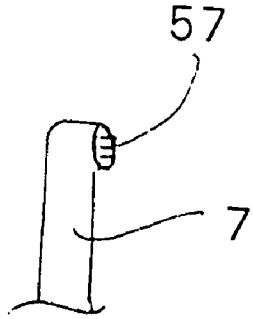

Turning to FIGS. 3*a–c*, it is to be appreciated that the opening 57 of the outlets 55 could be provided with a vertically dispensing opening as in FIG. 3*a*, a fully horizontal air dispensing opening as in FIG. 3*b*, an angled air dispensing opening as in FIG. 3*c* and even a nozzle type opening, i.e., the free end openings 57 having a smaller diameter than the outlet conduits 55 to accelerate the air flow therethrough.

The outlet conduits 7 may be arranged to align the free end opening 57 spaced from, i.e., generally below the grate 13, or the free end opening 57 may be connected with the grate 13 so that passages in the grate 13 are in direct communication with the outlet conduits 7 and thus provide more specific air flow direction to the footwear.

The main conduit 5 branches are attached to an atrium 47 of hot air which facilitates the communication of the forced hot air from the blower 9 and heating element 11 into the main conduit 5. The atrium 47 is a compartment immediately following the blower 9 which can be provided with baffles or other similar devices for directing the heat flow into the conduit branches. The atrium 47 may be of any size and shape to handle the amount of air flow generated by the blower 9, and serves mainly to efficiently disseminate the developed air flow to the main conduits 5. The atrium 47 may be made of any material which is known for handling forced hot air, for example metal, PVC or other such plastics, and may also be provided with alternative connection points 49 for attaching different arrangements of main conduits.

The grate 13, upon which the footwear is positioned, is generally a metal grate having a plurality of passages or slots 59 provided therethrough to enable hot air expelled from the outlets of the conduit 7 to pass through the passages and impact the footwear so as to melt the snow and ice therefrom. The slots 59 may be defined by long louvers 61 aligned at an angle which facilitates the desired heat flow of approximately 45° on to the footwear on top of the grate 13. This can be accomplished by utilizing a series of louvers 61 angled at 45° so that any air flow exiting through the grate 13 will be redirected by the louvers 61 into this 45° alignment relative to the horizontal plane of the grate 13.

In another embodiment, instead of louvers 61 and slots 59, the grate 13 may define independent passages which are aligned at a particular angle so as to direct the heat flow in the desired angle, yet will also accomplish the task of melting snow and ice off of a footwear and facilitating the passage of the melted snow and ice, i.e., water, through the grate 13 and back down into the catch basin 15 and out to drain. Also, the passages in the grate 13 may be provided with a communicating inlet to mate with the free end openings 57 in the outlet conduits 55, or even the main conduit 5 itself so that the passages directly receive the forced hot air and thus the grate 13 itself may directly effect the heat flow from the atrium 47 and conduit 5 onto the footwear.

The heated air may be heated to a temperature in the range of 100–200 degrees K (Kelvin) and may be developed by the blower to be expelled from the conduit at 25–100 cfm (cubic feet per minute) and more preferably about 50–75 cfm. The grate or fence 13 permits the snow or ice melted by this heated air flow to change stage essentially to water and fall off the wearer's footwear through the grate 13 and into a catch basin 15 from where it is disseminated to a drain 17. The drain 17 may be generally any type as known in the art and may be a simple percolating drain or the drain 17 may connect directly to a sewer and water collection system, for example, a municipal sewer.

In the broadest form of the present invention, a blower and heat source 9, 11 provided below a plane upon which footwear is placed provides a sufficient hot air flow directed onto the soles and sides of the footwear such that ice and snow is melted therefrom and directed into a drainage area 15. For example, this may be accomplished without the necessity for a housing or frame as previously discussed.

Figure 4:
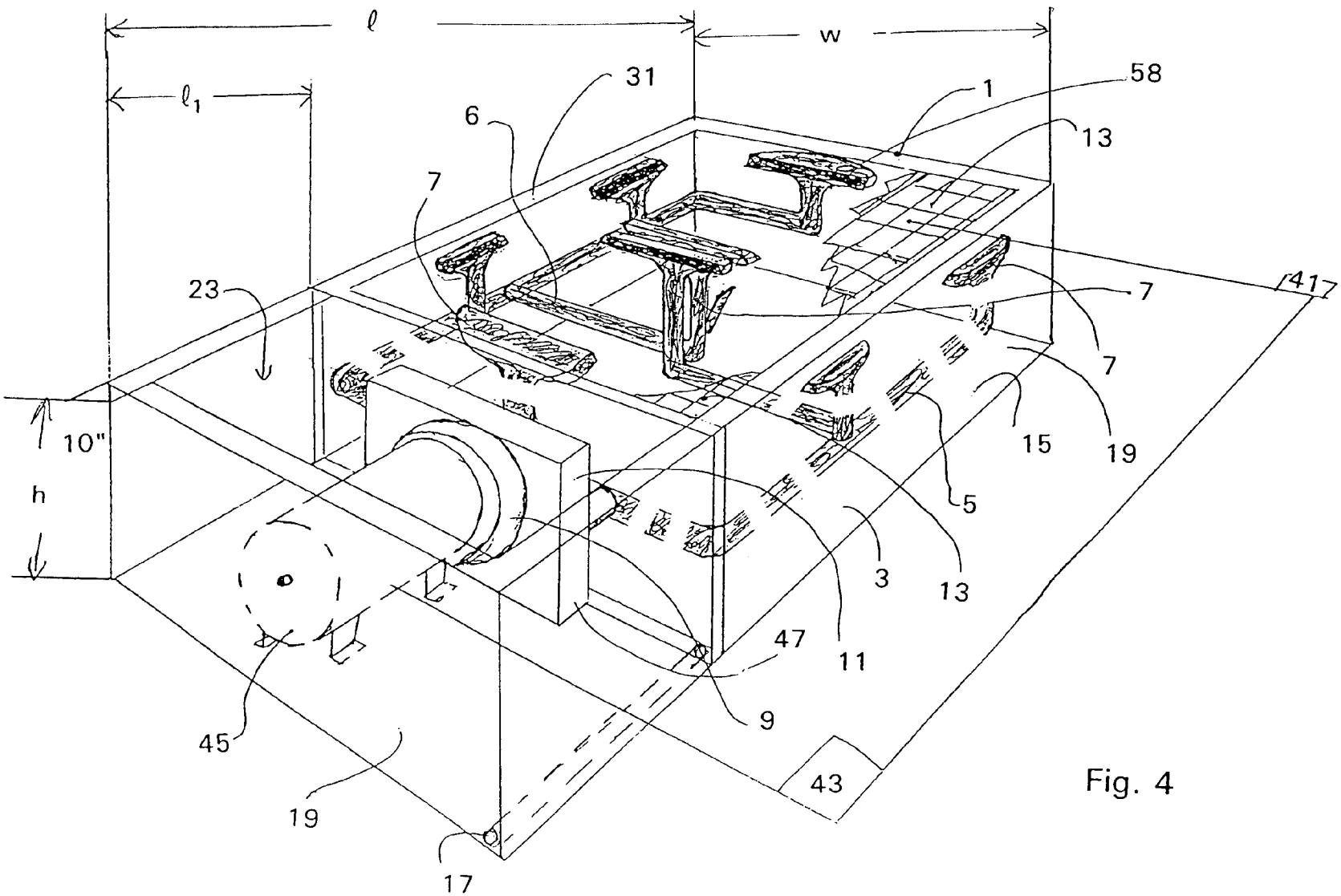
FIG. 4 is a perspective view of a second embodiment of the footwear snow-melting device.
Figure 5:
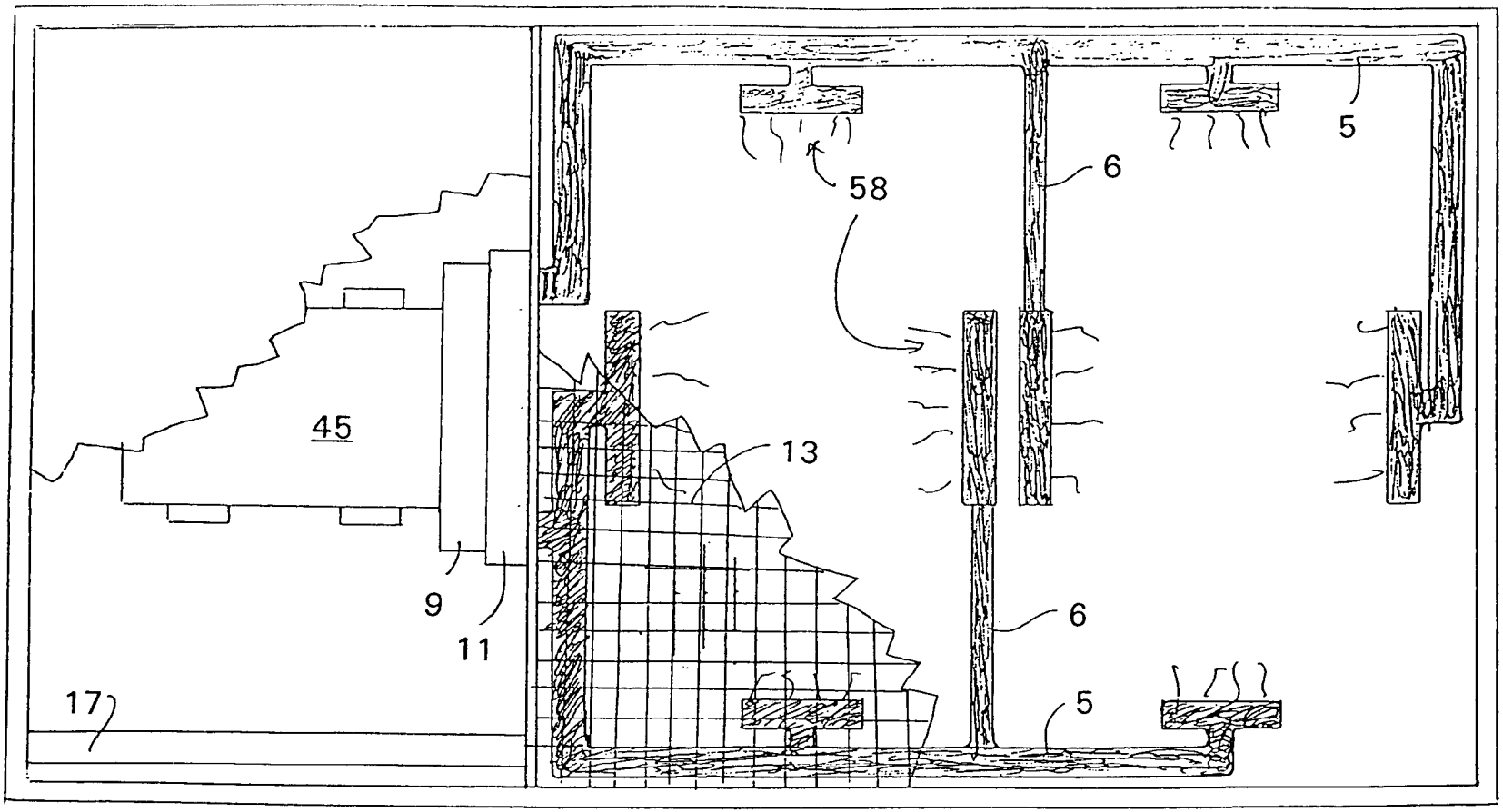
FIG. 5 is a top planar view of the second embodiment of the footwear snow-melting device.

In a further embodiment of the present invention shown in FIGS. 4 and 5, the main conduits 5 may divide the area to be heated into two portions, one for each of the wearer's left and right footwear. Each of the main conduits are provided with an inwardly extending branch 6 located substantially in the middle of the grate 13, these branches in turn may support further outlet conduits 7. In this embodiment with a left foot placed on a left portion of the grate 13, and a right foot placed on a right portion of the grate 13, the outlets 58 focus the air flow in the respective left and right portion and particularly on each individual left and right footwear so that more efficient melting of any snow or ice from the appropriate left and right footwear is accomplished.

Also in this embodiment, the outlets 7 are provided with an elongate free end opening 58 to provide for a more laminar flow of exiting heated air. These free end openings 58 are provided at a 45 angle so that the conduit is aimed directly at the sole of the footwear. The openings 58 are in effect substantially rectangular or oval in shape being about 6–10 inches across and 0.25 to 1.0 inches in height, aimed directly at the sole of the footwear and provide an opening area which will properly disseminate the air flow across a wide swath of the fence 13 and the footwear supported thereon.

Since certain changes may be made in the above described footwear melting device without departing from the spirit and scope of the invention herein involved, it is intended that all of the subject matter of the above description or shown in the accompanying drawings shall be interpreted merely as examples illustrating the inventive concept herein and shall not be construed as limiting the invention.

I claim:

1. A footwear snow-melting device comprising:

a housing having a first and a second section;

an opening in at least a portion of a top side of the first section of the housing;

a lattice covering the opening;

at least a main pipe conduit extending from the second section of the housing into the first section of the housing for supplying air flow through the lattice;

an air flow source for directing air through at least one opening in the pipe conduit, located in the second section of the housing and connected to the pipe conduit;

a heating means for heating air prior to entering the pipe conduit;

a drain extending from the first section of the housing to the exterior of the housing for removing water and debris;

a power switch for controlling the air flow source; and wherein a plurality of secondary outlet conduits communicate at a substantially 90 degree angle with the main pipe conduit, each outlet conduit further defining the opening at a free end of the outlet conduit located closer to the lattice than to the pipe conduit to provide a specifically directed air flow through the lattice and onto a user's footwear.

2. The footwear snow-melting device in claim 1, wherein the housing is made of a metal.

3. The footwear snow-melting device in claim 1, wherein the second section of the housing has a removable cover for convenient access to the air flow source.

4. The footwear snow-melting device in claim 1, wherein the first and second sections of the housing are separated by a divider.

5. The footwear snow-melting device in claim 1, wherein the opening in the pipe conduit is at an angle to the lattice such that air is substantially uniformly forced through the entire surface of the lattice.

6. The footwear snow-melting device in claim 1, wherein the air flow source is a motor-powered blower.

7. The footwear snow-melting device in claim 1, wherein the lattice is a metal grate structure with uniformly spaced holes.

8. The footwear snow-melting device in claim 1, wherein the heating means is an electrical resistance wire heater.

9. The footwear snow-melting device in claim 1, wherein the electric switch is a piezoelectric switch attached to a force sensor on the lattice.

10. The footwear snow-melting device in claim 1, wherein the opening in the outlet conduit directs the air emanating from the opening at substantially a 45 degree angle relative to the lattice upon which the user's footwear is placed.

11. The footwear snow-melting device in claim 1, wherein the lattice comprises a plurality of spaced apart louvers angled at about 45 degrees relative the a horizontal plane defined by a top surface of the lattice upon which the footwear is supported.

12. A footwear snow-melting device comprising:

a housing containing a blower for developing an air flow; a heating element for heating the air flow and a series of main conduits communicating with the blower for relaying the heated air flow to a desired location;

a plurality of exhaust openings formed in the series of main conduits directing the heated air flow towards a ventilated platform upon which footwear is positioned;

a catch basin aligned below the ventilated platform to capture any material removed from the footwear and direct such material to a drain; and wherein each of the exhaust openings comprises an outlet conduit extending from one of the series of main conduits, each outlet conduit having a free end spaced from the main conduit and located closer to the ventilated platform than to the main conduit to provide a specifically directed air flow at about 45 degrees through the ventilated platform and onto the footwear.

13. The footwear snow-melting device as set forth in claim 12, wherein the housing further comprises a blower enclosure for protecting the blower and the heating element and a conduit enclosure portion containing the series of conduits for directing the heated air.

14. The footwear snow-melting device as set forth in claim 13, wherein the housing further comprises a plurality of sidewalls supporting the ventilated platform over the conduit enclosure portion of the housing.

15. The footwear snow-melting device as set forth in claim 12, wherein the ventilated platform is provided with a plurality of passages for directing the heated air flow onto an outer surface of the footwear positioned thereon.

16. A method for removing snow and ice from footwear comprising:

forming a housing having a first and a second section;

placing the housing in front of a doorway;

creating an opening in at least a portion of a top side of the first section of the housing;

placing a lattice over the opening;

creating at least a main pipe conduit extending from the second section of the housing into the first section of the housing;

heating air prior to entering the pipe conduit;

directing heated air through at least an opening in the pipe conduit via an air flow source located in the second section of the housing and connected to the pipe conduit;

controlling the air flow source via a power switch;

removing water and debris from the second section of the housing via a drain; and defining the opening in the pipe conduit at a free end of a secondary outlet conduit extending from the main pipe conduit, and locating the free end of the outlet conduit closer to the lattice than to the main pipe conduit in order to provide a specifically directed air flow through the lattice and onto a user's footwear.

* * * * *